US005230736A

United States Patent [19]

Schnodewind

[11] Patent Number: 5,230,736

[45] Date of Patent: Jul. 27, 1993

[54] APPARATUS FOR APPLYING ADHESIVE TO ONE SIDE OF A POROUS WEB

[75] Inventor: Franz-Josef Schnodewind, Monchen-Gladbach, Fed. Rep. of Germany

[73] Assignee: Nordson Corporation, Westlake, Ohio

[21] Appl. No.: 461,351

[22] Filed: Jan. 5, 1990

[30] Foreign Application Priority Data

Jan. 11, 1989 [DE] Fed. Rep. of Germany ..... 3900619

[51] Int. Cl.[5] ..... B05B 15/00; B05C 9/08

[52] U.S. Cl. ..... 118/50; 118/68; 118/325

[58] Field of Search ..... 118/58, 63, 68, 69, 118/325, DIG. 4, 301, 50

[56] References Cited

U.S. PATENT DOCUMENTS 2,770,216 11/1956 Schock ..... 118/323
3,929,097 12/1975 Kanda et al. ..... 118/62
3,958,532 5/1976 Timson ..... 1118/412
4,364,801 12/1982 Salama ..... 118/301
4,472,461 9/1984 Johnson ..... 427/208.6
4,607,590 8/1986 Pender ..... 118/325
4,793,281 12/1988 Dobbins et al. ..... 118/63

FOREIGN PATENT DOCUMENTS 1055441 3/1967 United Kingdom .

*Primary Examiner*—Michael G. Wityshyn
*Attorney, Agent, or Firm*—Wood, Herron & Evans

[57] ABSTRACT

A method and apparatus for applying adhesive onto a porous web having opposed first and second sides, comprises at least one adhesive dispenser which applies adhesive in a first direction onto an adhesive application area located on the first side of the web. An air blower directs a stream of pressurized air through an opening in a plate over which the porous web passes so that the air stream contacts the second side of the porous web in an area opposite the adhesive application area. This prevents bleed-through of adhesive through the porous web without affecting the pattern of adhesive on the first side thereof.

7 Claims, 1 Drawing Sheet

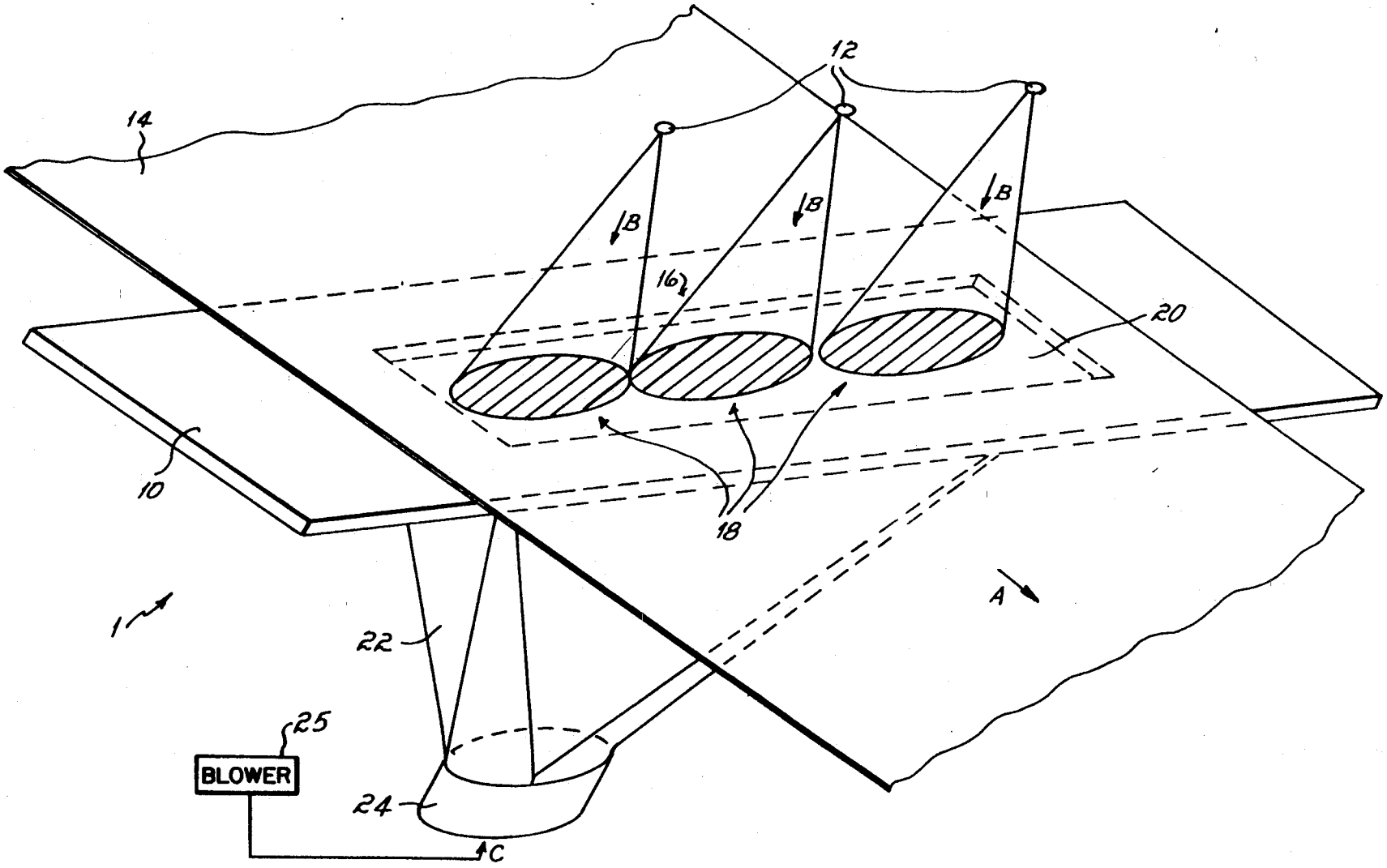
20
A
12
B
B
B
16
18
C
22
24
25
BLOWER
14
10
1

APPARATUS FOR APPLYING ADHESIVE TO ONE SIDE OF A POROUS WEB

FIELD OF THE INVENTION

The invention pertains to a system and to a process for the production of a porous web, especially of nonwoven material, provided on one side with an adhesive.

BACKGROUND OF THE INVENTION

Porous, absorbent materials are provided with adhesive on one side during the production, for example, of hygienic articles such as sanitary napkins and baby diapers. In particular, a liquefied hot melt adhesive is sprayed onto a web as it passes underneath the adhesive applicator. The material must be porous because it has to be absorbent, but because of this porosity, the adhesive penetrates to a greater or lesser depth into the material. In the case of highly porous materials such as nonwovens, this can lead to bleed-through; that is, the adhesive penetrates all the way through the web. This leads to considerable processing problems, such as the contamination of the pulleys and support rolls. The necessity of cleaning operations increases the cost of production, but in addition this bleed-through also brings with it the danger that the web material will stick to the rolls or other adhesive-contaminated parts of the machinery, which can lead to the rupture of the web.

SUMMARY OF THE INVENTION

It is therefore among the objectives of this invention to provide a process and a system of the type indicated above by means of which the danger of adhesive bleed-through is eliminated even in the case of highly porous web materials.

According to the invention, directing a stream of gas against the web on the side opposite that to which the adhesive is applied prevents the adhesive from bleeding through. Thus the adhesive is prevented from reaching the pulleys or rolls and other parts of the machinery. The contamination of these parts with adhesive is avoided, and web ruptures can be almost completely eliminated.

It is advantageous for the gas stream according to the invention to be realized in the form of unheated compressed air, which can be done at little expense.

In particular, when an adjustable blower is used, the gas stream can be adjusted easily to prevent excessive penetration of adhesive into the web without at the same time interfering with the uniform application of the adhesive.

DESCRIPTION OF THE DRAWINGS

The structure, operation and advantages of the presently preferred embodiment of this invention will become further apparent upon consideration of the following description, taken in conjunction with the accompanying FIG., which illustrate a preferred embodiment of a system according to the invention in the form of a schematic diagram.

DETAILED DESCRIPTION OF THE INVENTION

System 1 comprises a flat plate 10, over the top of which a web 14 of porous material, especially nonwoven material, to be provided with adhesive is conveyed in the direction of arrow A. Web 14 can be paid out, for example, from a supply roll (not shown) and wound up again on another supply roll (not shown) after the adhesive has been applied, and possibly a protective film has been attached.

Above plate 10 are spray devices 12, which are shown schematically in the drawing in the form of three individual spray nozzles. The spray nozzles of spray device 12 discharge a hot melt adhesive which has been liquefied by heat in the direction of arrows B onto web 14 and thus produce a spray pattern 18 in an application area 16 over a certain portion of the width of the web.

Plate 10 has a long, rectangular opening 20, the width of which is approximately the same as that of application area 16. Web 14 is guided to travel so closely to plate 10 and thus to opening 20 that it seals opening 20.

Underneath plate 20 is a nozzle 22, which is connected by a tubular connector 24 to an adjustable blower 25. Unheated, compressed air is conveyed by the blower 25 in the direction of arrow C through connector 24 to nozzle 22. In the area of opening 20, this unheated, compressed air strikes the underside of web 14. In application area 16, therefore, web 14 is subjected on one side to a stream of unheated, compressed air. The compressed air penetrates into the web material and prevents the adhesive being applied simultaneously from the opposite side from penetrating through the web material.

The supply rate of the compressed air should be selected so that the bleed-through of adhesive is reliably prevented without at the same time causing any interference with the uniform application of the adhesive.

Instead of the nozzle with tubular connector 24 shown in the drawing, which is suitable especially for connecting the blower to the connector by means of a compressed air hose, it is also possible to connect the nozzle directly to the blower, which makes it possible to save additional space.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

Therefore, it is intended that the invention not be limited to the particular embodiment disclosed as the best mode contemplated for carrying out this invention, but that the invention will include all embodiments falling within the scope of the appended claims.

I claim:

1. Apparatus for applying adhesive onto a porous web having opposed first and second sides, comprising:

means for dispensing adhesive in a first direction onto an adhesive application area located on the first side of the porous web;

means for directing a stream of air onto the second side of the porous web, opposite said application area, in a second direction which is substantially opposite to said first direction in which the adhesive is applied, so that the air at least partially penetrates the porous web and substantially prevents the adhesive from passing through the porous web.

2. The apparatus of claim 1 in which said means for directing a stream of air comprises:

a blower for discharging a stream of compressed air;

nozzle means connected to said blower for receiving the stream of compressed air and for distributing the compressed air over an area on said second side of the porous web opposite said adhesive application area so that the compressed air at least partially penetrates the porous web thereat.

3. Apparatus for applying adhesive onto a moving porous web having opposed first and second sides, comprising:

at least one adhesive dispenser mounted in position to apply adhesive in a first direction onto an adhesive application area located on the first side of the porous web;

a plate formed with at least one opening, the porous web being movable with respect to said plate so that at least a portion of the second side of the web opposite said adhesive application area passes over said opening in said plate;

means for directing a stream of air through said opening in said plate onto said portion of said second side of said porous web opposite said adhesive application area so that said stream of air at least partially penetrates the porous web at said portion of said second side and substantially prevents the adhesive from passing through the porous web thereat.

4. The apparatus of claim 3 in which said means for directing a stream of air comprises:

a blower for discharging a stream of compressed air;

at least one nozzle connected to said blower for receiving compressed air therefrom, said nozzle having a discharge outlet connected to said plate over said opening therein.

5. The apparatus of claim 4 in which said discharge outlet is rectangular in shape.

6. The apparatus of claim 4 in which said blower is an adjustable speed blower which is effective to vary the velocity of compressed air through said nozzle and into contact with the porous web so as to prevent penetration of adhesive through the porous web.

7. Apparatus for applying adhesive onto a porous web having opposed first and second sides comprising:

means for dispensing adhesive onto an adhesive application area located on the first side of the porous web;

means for at least partially penetrating the porous web with a flow of air directed toward the second side of the porous web, opposite said adhesive application area, to substantially prevent the passage of adhesive through the porous web.

* * * * *